US005546658A

United States Patent [19]

MacLeod et al.

[11] Patent Number: 5,546,658

[45] Date of Patent: Aug. 20, 1996

[54] NAIL CLIPPING AND COLLECTING DEVICE

[75] Inventors: David L. MacLeod, 2324 English Village La., Birmingham, Ala. 35223; Jack M. Sayler, Jr.; Lloyd B. Cooper, both of Birmingham, Ala.

[73] Assignees: David L. MacLeod; John M. Sayler, Jr., both of Birmingham, Ala.

[21] Appl. No.: 514,971

[22] Filed: Aug. 14, 1995

[51] Int. Cl.[6] ..... A45D 29/02

[52] U.S. Cl. ..... 30/28; 30/124

[58] Field of Search ..... 30/26, 28, 124, 30/125, 131; 132/73.5, 75, 75.3, 75.5, 75.6; 28/59, 60, 61, 62

[56] References Cited

U.S. PATENT DOCUMENTS

| | | | |
|---|---|---|---|
| D. 270,955 | 10/1983 | Hannon | D28/60 |
| D. 283,452 | 4/1986 | Boschetti | D28/62 |
| D. 292,328 | 10/1987 | Gamble | D28/62 |
| D. 307,195 | 4/1990 | Suppes | D28/60 |
| D. 309,038 | 7/1990 | Ladora | D28/60 |
| D. 345,628 | 3/1994 | Pacio | D28/60 |
| D. 347,296 | 5/1994 | Adelman | D28/60 |
| 3,722,518 | 3/1973 | Fravel | 132/75.6 |
| 3,855,698 | 12/1974 | Crosby | 30/124 |
| 4,550,496 | 11/1985 | Reinicke | 30/124 |
| 4,602,430 | 7/1986 | Allen, Jr. | 30/28 |
| 4,640,011 | 2/1987 | Gamble | 30/28 |
| 4,956,915 | 9/1990 | Anderson | 30/28 |
| 5,052,416 | 10/1991 | Rommerdale | 132/75.5 |

FOREIGN PATENT DOCUMENTS

| | | | |
|---|---|---|---|
| 2603467 | 3/1988 | France | 30/28 |

*Primary Examiner*—Hwei-Siu Payer
*Attorney, Agent, or Firm*—Donald A. Kettlestrings

[57] ABSTRACT

A nail clipping and collecting device for use with a conventional nail clipper is designed to be easily grasped and manipulated, particularly by persons with reduced or impaired manual dexterity. A conventional nail clipper is removably positioned within a base and within a handle of the device which are removably hingedly connected together, and the base is configured for receiving, storing and emptying nail clippings. The handle is configured for removably storing a nail file, and a magnifying lens is adjustably connected to the handle for positioning to magnify a nail to be cut.

23 Claims, 3 Drawing Sheets

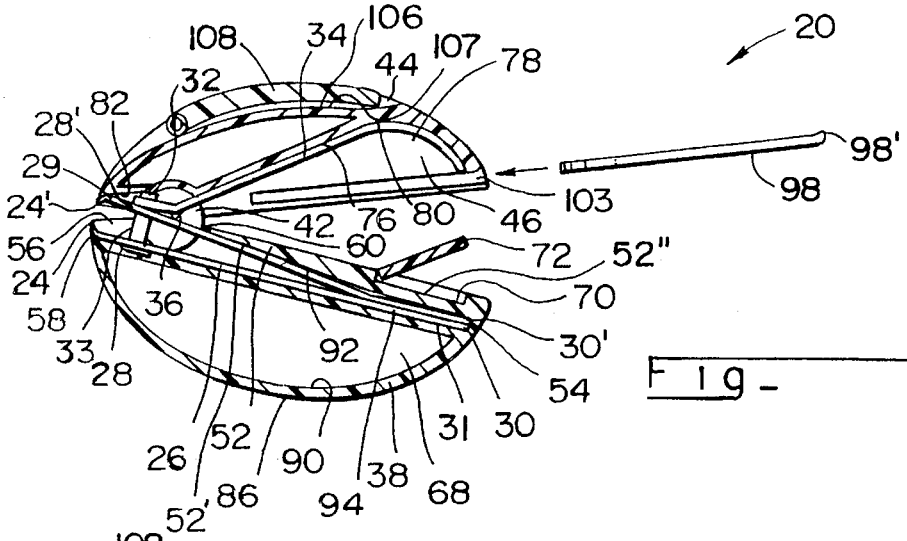
Fig- 5
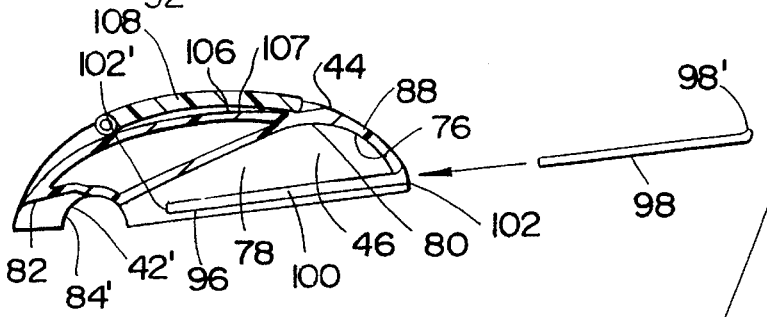
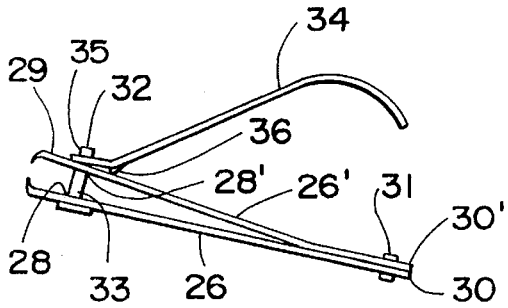
Fig- 6
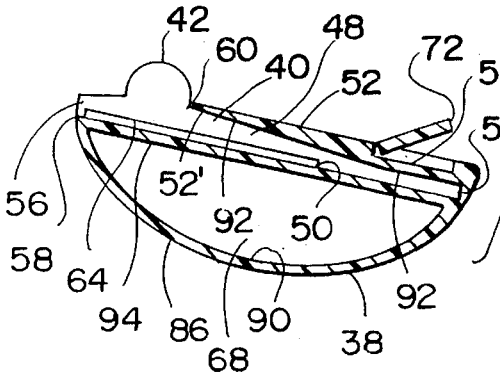

NAIL CLIPPING AND COLLECTING DEVICE

BACKGROUND OF THE INVENTION

This invention relates to a nail clipping device and more particularly to a nail clipping and collecting device for use with a conventional nail clipper.

Conventional nail clippers can be awkward to manipulate, and conventional nail clippers provide no means for collecting nail clippings. Accordingly, it is often difficult for individuals to operate conventional nail clippers and the nail clippings are often undesirably dispersed so as to require later cleaning or collection.

It is, therefore, an object of the present invention to provide a nail clipping and collecting device for use with a conventional nail clipper.

Another object is to provide such a device which can be quickly and easily removably connected to a conventional nail clipper.

A further object of the invention is the provision of such a device which is uniquely shaped and configured for easy grasping and manipulation.

Still another object is to provide such a device for receiving, storing and emptying nail clippings.

Yet another object of the present invention is the provision of such a device which is configured for removably storing a nail file.

A still further object is to provide such a device which includes a magnifying lens adjustably connected for positioning to magnify a nail to be cut.

Another object is to provide such a device which can be quickly and easily assembled and disassembled.

A further object of the invention is the provision of such a device which can be easily cleaned.

Additional objects and advantages of the invention will be set forth in part in the description which follows, and in part will be obvious from the description, or may be learned by practice of the invention. The objects and advantages are realized and attained by means of the instrumentalities and combinations particularly pointed out in the appended claims.

SUMMARY OF THE INVENTION

To achieve these and other objects the present invention provides a nail clipping and collecting device for use with a conventional nail clipper having first and second opposed clipping blades, first and second elongated arm members defining holes therein and extending respectively from the blades, the arm members connected at ends thereof, a post slideably extending through the holes in the arm members, and a fulcrum lever arm connected to the post and in contact with the second arm member at a fulcrum point, the nail clipping and collecting device comprising: a base defining a first cavity for removably receiving the first arm member, a first portion of the second arm member and a first portion of the post substantially within the cavity and further defining a first hinge element; a handle defining a second cavity for removably receiving a second portion of the second arm member, the fulcrum lever arm and a second portion of the post substantially within the second cavity when the base and the handle are hingedly connected together; and the handle further defining a second hinge element for removably connecting to the first hinge element, whereby the base and the handle can be removably hingedly connected together with the conventional nail clipper in position within the first and second cavities.

It is to be understood that both the foregoing general description and the following detailed description are exemplary and explanatory but are not restrictive of the invention.

BRIEF DESCRIPTION OF THE DRAWINGS

The accompanying drawings, which are incorporated in and constitute a part of this specification, illustrate an example of a preferred embodiment of the invention and, together with the description, serve to explain the principles of the invention.

FIG. 5 is a cross-sectional view of the device taken along the line 5—5 in FIG. 1 and looking in the direction of the arrows; and FIG. 6 is an exploded cross-sectional view of the device as shown in FIG. 5.

DESCRIPTION OF THE PREFERRED EMBODIMENTS

Figure 1:
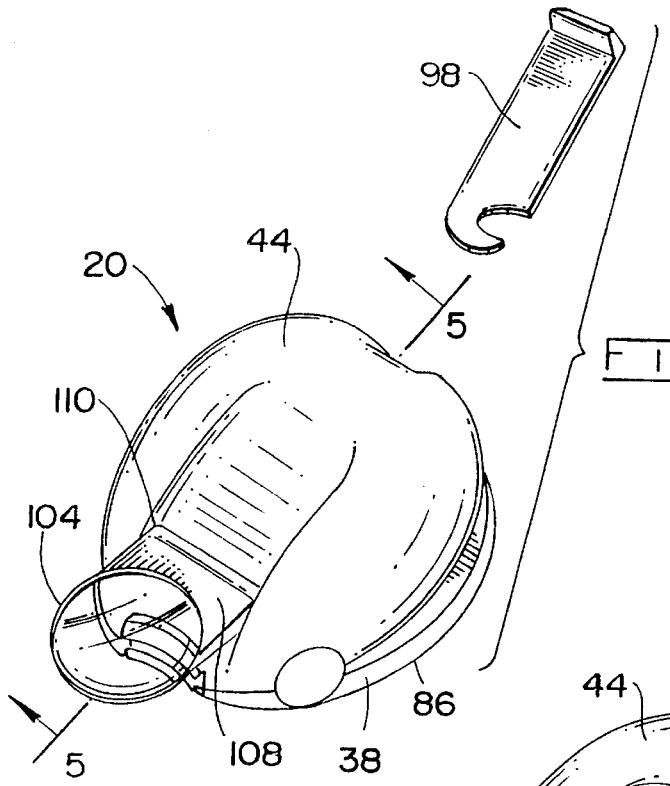
FIG. 1 is a perspective view of the nail clipping and collecting device with a conventional nail clipper in position in the device, showing the magnifying lens in operative position and showing a nail file removed from the device.

With reference now to the drawings, wherein like reference characters designate like or corresponding parts throughout the several views, there is shown a nail clipping and collecting device 20 for use with a conventional nail clipper 22 having first and second opposed clipping blades 24, 24'. Nail clipper 22 further includes first and second elongated arm members 26, 26' defining holes 28, 28' therein and extending respectively from blades 24, 24'. Arm members 26, 26' of conventional nail clipper 22 are connected together in a conventional manner by connector 31 at ends 30, 30' thereof, and a post 32 slideably extends through holes 28, 28'. Nail clipper 22 further includes a fulcrum lever arm 34 which is connected to post 32 in a conventional manner and which is in contact with second arm member 26' at a fulcrum point 36.

In accordance with the invention, nail clipping and collecting device 20 includes a base 38 which defines a first cavity 40 for removably receiving first arm member 26, a first portion 27 of second arm member 26' and a first portion 33 of post 32 within cavity 40. Base 38 also defines a first hinge element 42.

Device 20 further includes a handle 44 which defines a second cavity 46 therein for removably receiving a second portion 29 of second arm member 26', fulcrum lever arm 34 and a second or upper portion 35 of post 32 within second cavity 46 when base 38 and handle 44 are hingedly connected together. Handle 44 further defines a second hinge element 42' for removably connecting to first hinge element 42 so that base 38 and handle 44 can be removably hingedly connected together with nail clipper 22 in position within cavities 40, 46.

First cavity 40 is defined by first and second opposed sidewalls 48, 48', a bottom wall 50, a top wall 52, a first closed end 54 and a second open end 56. Bottom wall 50 is longer than a predetermined portion 52' of top wall 52, and bottom wall 50 defines a forward edge 58 contiguous with open end 56 of first cavity 40. Predetermined portion 52' of top wall 52 defines a forward edge 60 contiguous with open end 56 of first cavity 40. Bottom wall 50 defines first and second opposed side edges 62, 62' and sidewalls 48, 48' define first and second openings 64, 64', respectively, therein extending along and contiguous with predetermined length portions 66, 66' of side edges 62, 62', respectively.

Base 38 further defines a third cavity 68 in fluid communication with openings 64, 64' so that nail clippings can be transferred to and collected within cavity 68 from cavity 40 by tipping and moving device 20 to permit the clippings to pass from cavity 40 through one or both of openings 64, 64' and downwardly into cavity 68.

Top wall 52 extends laterally beyond sidewalls 48, 48', and a reduced thickness portion 52" extends between sidewalls 48, 48'. A pocket for receiving portions of arm members 26, 26' of clipper 22 is formed at the end of cavity 40 by bottom wall 50, sidewalls 48, 48' and portion 52". Wall 52 defines a third opening 70 on either side of sidewalls 48, 48' in fluid communication with cavity 68. Device 20 further includes a cover 72 hingedly connected to top wall 52 in a conventional manner for selectively opening and closing opening 70 so that nail clippings stored within cavity 68 can be emptied outwardly through opening 70 by opening cover 72 and inverting device 20.

Top wall 52 defines an upper surface 53. First hinge element 42 includes first and second semi-cylindrical hinge members 74, 74' in axial alignment with each other along a first predetermined axis (not shown) and spaced apart from each other on opposite sides of open end 56 of cavity 40. Hinge members 74, 74' protrude upwardly from upper surface 53.

Second cavity 46 in handle 44 is defined by an upper wall 76 and third and fourth opposed sidewalls 78,78'. Upper wall 76 defines a first upper wall portion 80 configured for receiving fulcrum lever arm 34 against upper wall portion 80. Upper wall 76 further defines a second upper wall portion 82 configured for receiving second, upper portion 35 of post 32 and second portion 29 of second arm member 26' against upper wall portion 82.

In accordance with the invention, second hinge element 42' includes first and second semi-cylindrical channels 84, 84' in axial alignment with each other along a second predetermined axis (not shown) and spaced apart from each other on opposite sides of cavity 46. Hinge members 74, 74' and channels 84, 84' are relatively sized for enabling hinge members 74, 74' to removably and rotatably snap-fit into channels 84, 84', respectively, with the aforementioned first and second axes (not shown) in alignment with each other. As a result, base 38 and handle 44 can be rotated with respect to each other about the aligned first and second axes by relative rotational movement of hinge members 74, 74' within channels 84, 84', respectively.

Conventional nail clipper 22 and cavities 40, 46 are sized and configured so that fulcrum point 36 of nail clipper 22 is in alignment with the aforementioned first and second axes (not shown) when nail clipper 22 is positioned with cavities 40, 46.

Base 38 and handle 44 define convex exterior surfaces 86, 88, respectively, for ease of handling and manipulation of device 20. Device 20 is substantially egg-shaped in appearance, and this shape allows device 20 to be comfortably held in one hand and clenched during its use. The egg-shape of device 20 allows for the distribution of pressure by the user over a large surface area without reducing the amount of force which is applied to the device and which is required to cleanly and precisely cut a nail. This is an important feature and advantage for the aged or arthritic person.

Cavity 68 within base 38 is defined by an inner portion 90 opposite from base exterior surface 86, by an inner portion 92 of top wall 52, by a lower portion 94 of bottom wall 50 and by sidewalls 48, 48'.

Device 20 also includes first means generally indicated at 96 in operative relationship with handle 44 for removably receiving and storing a nail file 98 within handle 44. First means 96 preferably include first and second opposed, open-ended slots 100, 100' defined within handle 44 and contiguous with cavity 46. Slots 100, 100' are sized and spaced apart from each other in a predetermined manner for slideably receiving and storing nail file 98 within slots 100, 100'. Each of slots 100, 100' defines an open end 102 and a closed end 102'. A recessed portion 103 is provided in exterior surface 88 and adjacent to open ends 102 of slots 100, 100' for enabling a user to grasp and remove file 98 from slots 100, 100'.

Figure 2:
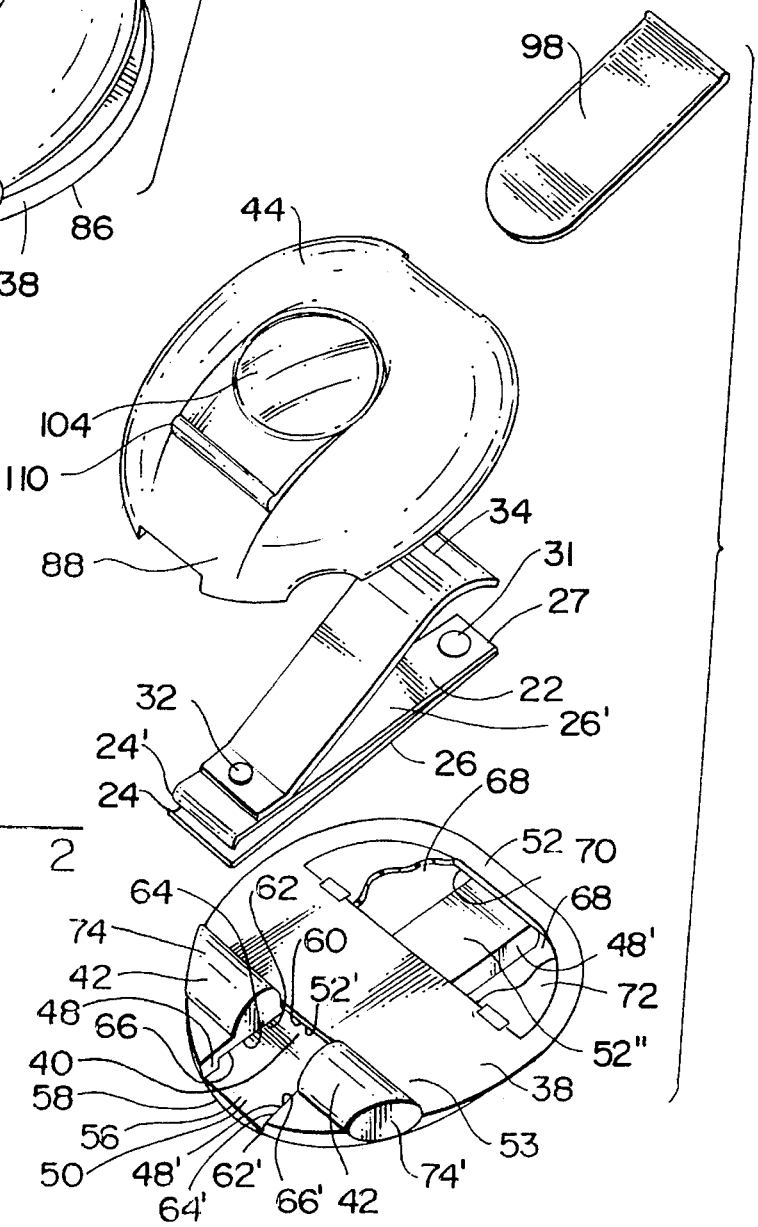
FIG. 2 is an exploded top perspective view of the device.
Figure 3:
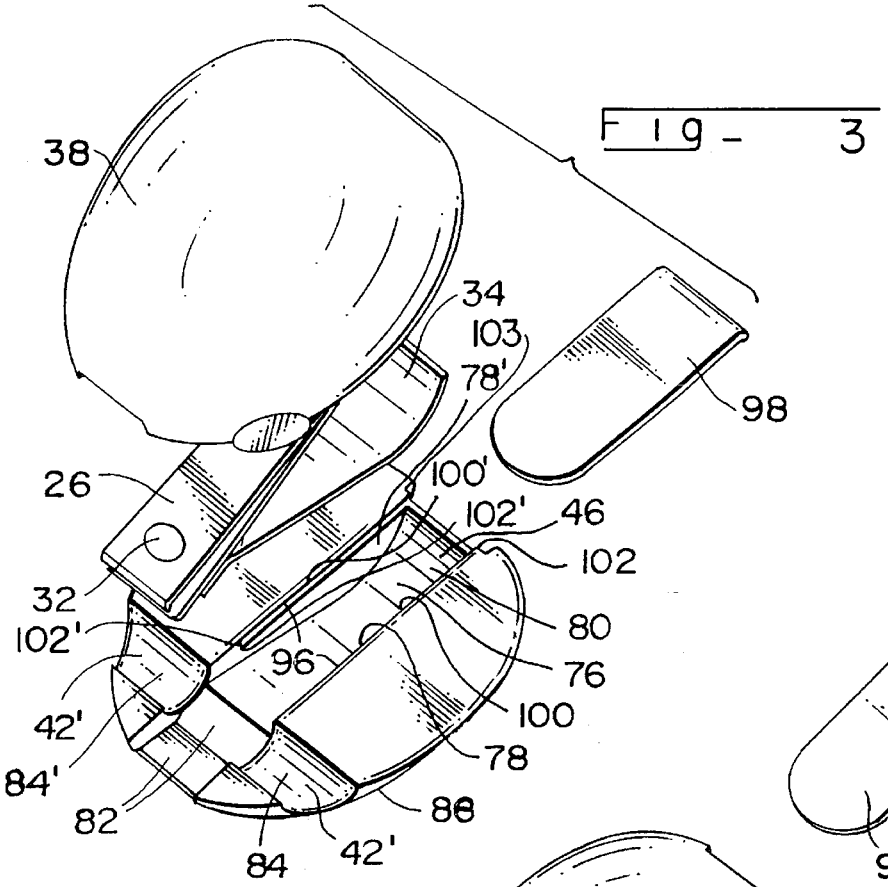
FIG. 3 is an exploded bottom perspective view of the device.
Figure 4:
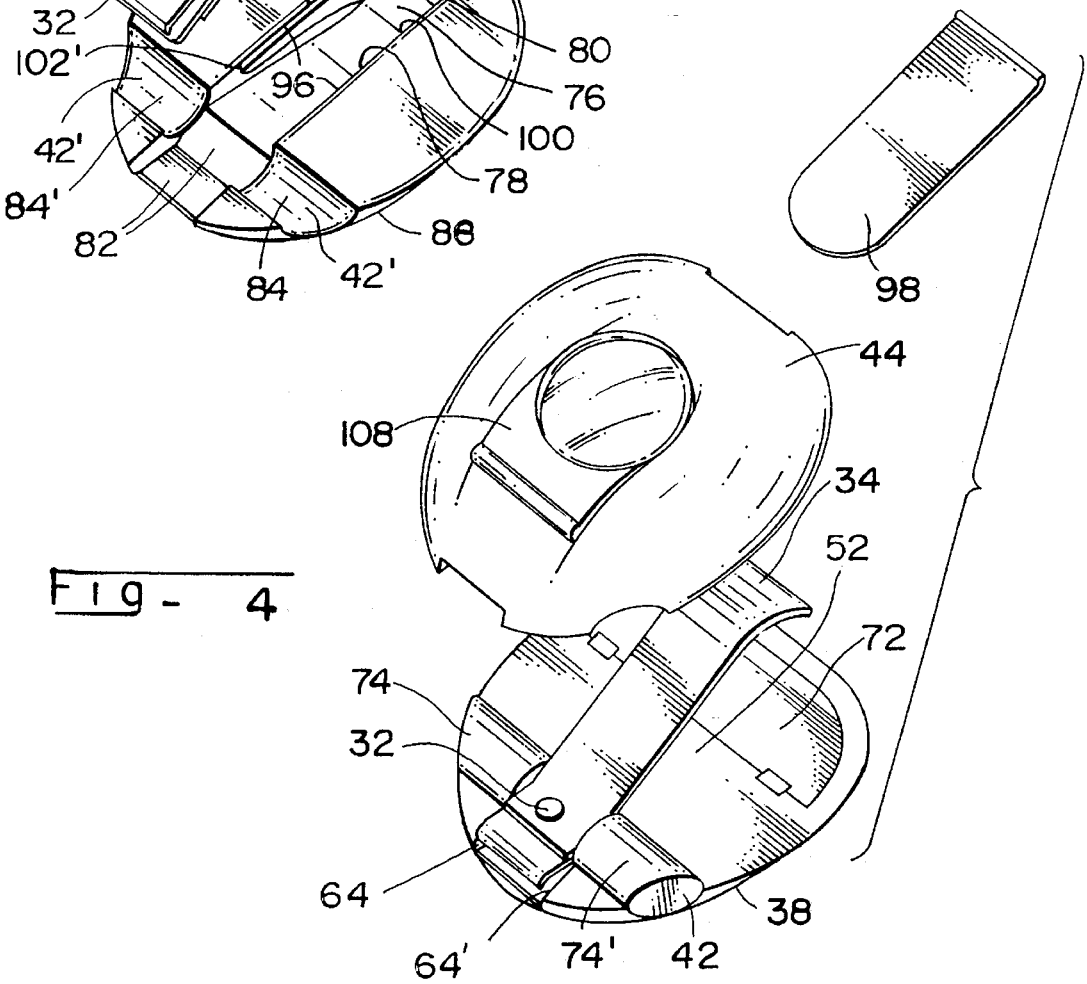
FIG. 4 is a partially exploded top perspective view of the device.

In accordance with the invention, device 20 also includes a magnifying lens 104 adjustably connected to handle 44 for selective positioning in a first position to magnify a nail located adjacent to clipping blades 24, 24'. This configuration is best illustrated in FIG. 1. Magnifying lens 104 is selectively positionable in a second, recessed position (FIG. 2) for storing the lens when the lens is not in use.

Exterior surface 88 of handle 44 defines a recessed portion 106 therein for receiving magnifying lens 104 in the stored position. A lens support 108 is attached to lens 104 and is rotatably connected to handle 44 at location 110 within recessed portion 106. Lens 104 and lens support 108 are configured to be flush with exterior surface 88 of handle 44 when lens 104 is in the stored position.

Handle 44 can be hollow, as illustrated, between upper wall portion 80 and exterior surface 88, or handle 44 can be solid between wall portion 80 and surface 88. It is also preferred that cavity 68 within base 38 be one cavity which extends beneath portion 94 of bottom wall 50.

In operation and use, device 20 is assembled by inserting conventional clipper 22 into cavity 40. Cavity 40 is configured to receive ends 30, 30' of clipper 22 against closed end 54 of cavity 40. Cavity 40 is also configured to receive first portion 27 of arm member 26', arm member 26 and first or lower portion 33 of post 32 within cavity 40.

Fulcrum lever arm 34 of clipper 22 is then positioned within cavity 46 with fulcrum lever arm 34 positioned against upper wall portion 80. Cavity 46 also receives second portion 29 of arm member 26' and upper portion 35 of post 32 therein. File 98 can then be slideably inserted into slots 100, 100'.

Handle 44 and base 38 are then hingedly connected together by snap-fitting channels 84, 84' over hinge members 74, 74', respectively.

In use, the operator, if necessary, can position magnifying lens 104 to provide magnification of a nail to be clipped when the nail is positioned between blades 24, 24'. Device 20 is then grasped by the user in one hand as a nail to be clipped is inserted and positioned between opposed blades 24, 24' of clipper 22. Force is then applied by the user by squeezing together base 38 and handle 44. The force as applied to exterior surfaces 86, 88 by the user causes base 38 and handle 44 to rotate with respect to each other about fulcrum point 36 and the axes (not shown) of channels 84, 84' and hinge members 74, 74'. This, in turn, causes clipper 22 to operate in a conventional manner to move blades 24, 24' together and to cut the nail positioned between the blades.

The nail clipping will fall onto arm member 26 behind blade 24. By slightly tipping device 20, the user can then cause the nail clipping to pass through one of openings 64, 64' and downwardly into nail clipping collecting cavity 68.

When it is desired to empty collected nail clippings from cavity 68, cover 72 is opened and device 20 is tipped or inverted so that the nail clippings will fall from cavity 68 and outwardly through opening 70.

If it is desired to use file 98, it can be removed from device 20 by grasping end 98' and by slideably withdrawing the file from slots 100, 100'. The file can be quickly and easily replaced into the slots by simply slideably inserting the file back into the slots. The depths of slots 100, 100' and the thickness of file 98 can be made so that the wall portions of the slots lightly frictionally engage file 98 to prevent the file from accidentally falling out of the slots.

Upon completing the nail clipping process, the user can reposition magnifying lens 104 by rotating the lens and lens support 108 about pivot 110 so that lens 104 and lens support 108 are repositioned within recessed portion 106 of handle 44. Lens 104 and lens support 108 are configured to be flush with exterior surface 88 of handle 44 when in the stored position so that a user can easily grasp and operate device 20 when lens 104 and lens support 108 are positioned within recessed portion 106.

If it is desired to clean or to disassemble device 20, nail file 98 can be removed from slots 100, 100'. Handle 44 can then be quickly and easily separated from base 38 by grasping the handle and the base and by separating hinge members 74, 74' from channels 84, 84'. Fulcrum lever arm 34 of clipper 22 is then removed from cavity 46 of handle 44, and arm members 26, 26' can be removed from cavity 40 in base 38. Device 20 can then be cleaned, and nail clipping collecting cavity 68 can be flushed or otherwise cleaned to remove any nail clippings remaining in the cavity. The flushing or cleaning of cavity 68 can be accomplished by opening cover 72 and by flushing or cleaning through opening 70.

Device 20 is preferably made from a durable plastic material. The magnification provided by lens 104 when the lens is in the retracted or stored position will allow for the strategic placement of a corporate logo or business emblem on surface 107 of recessed portion 106 so that the logo or business emblem will be magnified when lens 104 is in its retracted or stored position.

The invention in its broader aspects is not limited to the specific details shown and described, and departures may be made from such details without departing from the principles of the invention and without sacrificing its chief advantages.

What is claimed is:

1. A nail clipping and collecting device for use with a nail clipper having first and second opposed clipping blades, first and second elongated arm members defining holes therein and extending respectively from said blades, said arm members connected together at ends thereof, a post slidably extending through said holes in said arm members, and a fulcrum lever arm connected to said post and in contact with said second arm member at a fulcrum point, said nail clipping device comprising:

a base defining a first cavity for removably receiving said first arm member, a first portion of said second arm member and a first portion of said post substantially within said cavity and further defining a first hinge element;

a handle defining a second cavity for removably receiving a second portion of said second arm member, said fulcrum lever arm and a second portion of said post substantially within said second cavity when said base and said handle are hingedly connected together; and said handle further defining a second hinge element for removably connecting to said first hinge element, whereby said base and said handle can be removably hingedly connected together with said nail clipper in position within said first and second cavities.

2. A device as in claim 1 further including first means in operative relationship with said handle for removably receiving and storing a nail file within said handle.

3. A device as in claim 2 further including a magnifying lens adjustably connected to said handle for selective positioning in a first position to magnify a nail located adjacent to said clipping blades.

4. A device as in claim 3 wherein said magnifying lens is selectively positionable in a second position for storing said lens when said lens is not in use.

5. A device as in claim 4 wherein said handle defines an exterior surface having a recessed portion therein for receiving said magnifying lens in said second, stored position.

6. A device as in claim 5 further including:

a lens support attached to said lens and rotatably connected to said handle within said recessed portion of said handle; and said lens and said lens support configured to be substantially flush with said exterior surface of said handle when said lens is in said second, stored position.

7. A device as in claim 2 wherein said first means include first and second opposed, open-ended slots defined within said handle and contiguous with said second cavity, said slots spaced apart from each other in a predetermined manner for slidably receiving and storing said nail file within said slots.

8. A device as in claim 1 wherein said first cavity is substantially defined by first and second opposed sidewalls, a bottom wall, a top wall, a first closed end and a second open end.

9. A device as in claim 8 wherein said bottom wall is longer than a predetermined portion of said top wall and defines a forward edge contiguous with said open end of said first cavity, and wherein said predetermined portion of said top wall defines a forward edge contiguous with said open end of said first cavity.

10. A device as in claim 9 wherein said bottom wall defines first and second opposed side edges and wherein said first and second sidewalls define first and second openings, respectively, therein extending along and contiguous with predetermined portions of said first and second side edges, respectively, and wherein said base further defines a third cavity in fluid communication with said first and second openings, whereby nail clippings can be transferred to and collected within said third cavity from said first cavity by tipping and moving said device to permit the clippings to pass from said first cavity through one or both of said openings and downwardly into said third cavity.

11. A device as in claim 10 wherein said top wall extends beyond said sidewalls and defines a third opening in fluid communication with said third cavity and further including a cover hingedly connected to said top wall for selectively opening and closing said third opening, whereby nail clippings stored within said third cavity can be emptied through said third opening by opening said cover and inverting said device.

12. A device as in claim 11 wherein said top wall defines an upper surface and wherein said first hinge element includes first and second substantially semi-cylindrical hinge members in substantial axial alignment with each other along a first predetermined axis and spaced apart from each other on opposite sides, respectively, of said open end of said first cavity and protruding upwardly from said upper surface of said top wall.

13. A device as in claim 12 wherein said second cavity is defined by an upper wall and third and fourth opposed sidewalls.

14. A device as in claim 13 wherein said upper wall defines a first upper wall portion configured for receiving said fulcrum lever arm substantially against said first upper wall portion.

15. A device as in claim 14 wherein said upper wall further defines a second upper wall portion configured for receiving said second portion of said post and said second portion of said second arm member substantially against said second upper wall portion.

16. A device as in claim 15 wherein said second hinge element includes:

first and second substantially semi-cylindrical channels in substantial axial alignment with each other along a second predetermined axis and spaced apart from each other on opposite sides, respectively, of said second cavity; and said first and second hinge members and said first and second channels sized for enabling said hinge members to removably and rotatably snap-fit into said channels with said first and second axes in substantial alignment with each other, whereby said base and said handle can be rotated with respect to each other by relative movement of said hinge members within said channels.

17. A device as in claim 16 wherein said nail clipper and said first and second cavities are sized and configured to provide said fulcrum point of said nail clipper in substantial alignment with said first and second axes when said nail clipper is positioned within said first and second cavities.

18. A device as in claim 17 wherein said base and said handle define convex exterior surfaces for ease of handling and manipulation of said device.

19. A device as in claim 18 wherein said third cavity is substantially defined by an inner portion of said base exterior surface, by an inner portion of said top wall, by a lower portion of said bottom wall and by said first and second sidewalls.

20. A device as in claim 1 wherein said second cavity is defined by an upper wall and third and fourth opposed sidewalls.

21. A device as in claim 20 wherein said upper wall defines a first upper wall portion configured for receiving said fulcrum lever arm substantially against said first upper wall portion.

22. A device as in claim 21 wherein said upper wall further defines a second upper wall portion configured for receiving a portion of said post and a portion of said second arm member substantially against said second upper wall portion.

23. A device as in claim 1 wherein said nail clipper and said first and second cavities are sized and configured to provide said fulcrum point of said nail clipper in substantial alignment with said first and second cavities when said nail clipper is positioned within said first and second cavities.

* * * * *